US005276270A

United States Patent [19]

Kondo

[11] Patent Number: 5,276,270

[45] Date of Patent: Jan. 4, 1994

[54] SOLENOID DRIVE SYSTEM FOR AN AUTOMATIC PERFORMING APPARATUS

[75] Inventor: Tetsusai Kondo, Hamamatsu, Japan

[73] Assignee: Kabushiki Kaisha Kawai Gakki Seisakusho, Japan

[21] Appl. No.: 950,083

[22] Filed: Sep. 23, 1992

[30] Foreign Application Priority Data

Nov. 13, 1991 [JP] Japan ..... 3-297456

[51] Int. Cl.[5] ..... G10F 1/02; G10F 5/00; G10G 3/04

[52] U.S. Cl. ..... 84/22; 84/115; 84/462

[58] Field of Search ..... 84/21, 22, 115, 462, 84/609-614

[56] References Cited

U.S. PATENT DOCUMENTS 4,132,141 1/1979 Campbell et al. .
4,469,000 9/1984 Fujiwara et al. ..... 84/115

FOREIGN PATENT DOCUMENTS 53-20315 2/1978 Japan .
53-102020 9/1978 Japan .
58-18691 2/1983 Japan .
58-179894 10/1983 Japan .
61-128295 6/1986 Japan .
63-37395 2/1988 Japan .
63-217908 8/1988 Japan .
63-301997 12/1988 Japan .
64-44936 2/1989 Japan .
64-247666 9/1989 Japan .
64-291944 11/1989 Japan .
1-332912 12/1989 Japan .
2164192 3/1986 United Kingdom .
WO80/02886 12/1980 World Int. Prop. O. .

*Primary Examiner*—Stanley J. Witkowski
*Attorney, Agent, or Firm*—Davis, Bujold & Streck

[57] ABSTRACT

A solenoid drive system enabling an automatic performing apparatus to control the intensity of key depression with respect to individual keys. Voltage waveform data is provided for each of the solenoids to drive an associated keys. One cycle of the voltage waveform data is divided in a predetermined time period into a predetermined number of bit segments. A value of "1" or "0", representing a pulse height level of the control signal for each respective key is written to each and every bit segment. Duty cycle of the square wave of each of the control signals can be thus precisely varied according to and to match the key depression intensity. The voltage waveform data may be written to sequential addresses in the memory, and read out from non-sequential addresses in the memory. Alternatively, the voltage waveform data may be written to non-sequential addresses in the memory and read out from sequential addresses in the memory.

13 Claims, 12 Drawing Sheets

| ADDRESS | D8 | D7 | D6 | D5 | D4 | D3 | D2 | D1 |
|---|---|---|---|---|---|---|---|---|
| 0000 | S08 | S07 | S06 | S05 | S04 | S03 | S02 | S01 |
| 0001 | S08 | S07 | S06 | S05 | S04 | S03 | S02 | S01 |
| 0002 | S08 | S07 | S06 | S05 | S04 | S03 | S02 | S01 |
| | | | | | | | | |
| 003E | S08 | S07 | S06 | S05 | S04 | S03 | S02 | S01 |
| 003F | S08 | S07 | S06 | S05 | S04 | S03 | S02 | S01 |
| 0040 | S08 | S07 | S06 | S05 | S04 | S03 | S02 | S01 |
| 0041 | S08 | S07 | S06 | S05 | S04 | S03 | S02 | S01 |
| | | | | | | | | |
| 007E | S08 | S07 | S06 | S05 | S04 | S03 | S02 | S01 |
| 007F | S08 | S07 | S06 | S05 | S04 | S03 | S02 | S01 |
| 0080 | S016 | S015 | S014 | S013 | S012 | S011 | S010 | S09 |
| 0081 | S016 | S015 | S014 | S013 | S012 | S011 | S010 | S09 |
| 0082 | S016 | S015 | S014 | S013 | S012 | S011 | S010 | S09 |
| | | | | | | | | |
| 00FF | S016 | S015 | S014 | S013 | S012 | S011 | S010 | S09 |

Fig.10A

| | | | | | | | | | | | |
|---|---|---|---|---|---|---|---|---|---|---|---|
| MEMORY ADDRESS → | A10 | A9 | A8 | A7 | A6 | A5 | A4 | A3 | A2 | A1 | A0 |
| ADDRESS GENERATOR → | Q3 | Q2 | Q1 | Q0 | Q10 | Q9 | Q8 | Q7 | Q6 | Q5 | Q4 |
| | 0 | 0 | 0 | 0 | 0 | 0 | 0 | 0 | 0 | 0 | 0 |

LATCH La1

0000H

Fig.10B

| | | | | | | | | | | | |
|---|---|---|---|---|---|---|---|---|---|---|---|
| MEMORY ADDRESS → | A10 | A9 | A8 | A7 | A6 | A5 | A4 | A3 | A2 | A1 | A0 |
| ADDRESS GENERATOR → | Q3 | Q2 | Q1 | Q0 | Q10 | Q9 | Q8 | Q7 | Q6 | Q5 | Q4 |
| | 0 | 0 | 0 | 1 | 0 | 0 | 0 | 0 | 0 | 0 | 0 |

LATCH La2

0080H

Fig.11

| ADDRESS | D8 | D7 | D6 | D5 | D4 | D3 | D2 | D1 | |
|---|---|---|---|---|---|---|---|---|---|
| 0000 | S08 | S07 | S06 | S05 | S04 | S03 | S02 | S01 | → LATCH La1 |
| 0080 | S016 | S015 | S014 | S013 | S012 | S011 | S010 | S09 | → LATCH La2 |
| 0100 | S024 | S023 | S022 | S021 | S020 | S019 | S018 | S017 | → LATCH La3 |
| | | | | | | | | | ⋮ |
| 0500 | S088 | S087 | S086 | S085 | S084 | S083 | S082 | S081 | → LATCH La11 |
| 0580 | | | | | | | SOS | SOL | → LATCH La12 |
| 0001 | S08 | S07 | S06 | S05 | S04 | S03 | S02 | S01 | → LATCH La1 |
| 0081 | S016 | S015 | S014 | S013 | S012 | S011 | S010 | S09 | → LATCH La2 |
| 0101 | S024 | S023 | S022 | S021 | S020 | S019 | S018 | S017 | → LATCH La3 |
| | | | | | | | | | ⋮ |
| 057F | S088 | S087 | S086 | S085 | S084 | S083 | S082 | S081 | → LATCH La11 |
| 05FF | | | | | | | SOS | SOL | → LATCH La12 |
| 0000 | S08 | S07 | S06 | S05 | S04 | S03 | S02 | S01 | → LATCH La1 |
| 0080 | S016 | S015 | S014 | S013 | S012 | S011 | S010 | S09 | → LATCH La2 |

Fig.13A

| ADDRESS BUS OF CPU | ADDRESS TERMINAL OF MEMORY | OUTPUT OF ADDRESS GENERATOR |
|---|---|---|
| AB0 | A0 | Q4 |
| AB1 | A1 | Q5 |
| AB2 | A2 | Q6 |
| AB3 | A3 | Q7 |
| AB4 | A4 | Q8 |
| AB5 | A5 | Q9 |
| AB6 | A6 | Q10 |
| AB7 | A7 | Q0 |
| AB8 | A8 | Q1 |
| AB9 | A9 | Q2 |
| AB10 | A10 | Q3 |

Fig.13B

| ADDRESS BUS OF CPU | ADDRESS TERMINAL OF MEMORY | OUTPUT OF ADDRESS GENERATOR |
|---|---|---|
| AB4 | A0 | Q0 |
| AB5 | A1 | Q1 |
| AB6 | A2 | Q2 |
| AB7 | A3 | Q3 |
| AB8 | A4 | Q4 |
| AB9 | A5 | Q5 |
| AB10 | A6 | Q6 |
| AB0 | A7 | Q7 |
| AB1 | A8 | Q8 |
| AB2 | A9 | Q9 |
| AB3 | A10 | Q10 |

SOLENOID DRIVE SYSTEM FOR AN AUTOMATIC PERFORMING APPARATUS

BACKGROUND OF THE INVENTION

This invention relates to a solenoid drive system for an automatic performing apparatus having actuating keys such as a piano or key board. The solenoid drive system stores voltage waveform data in sequence according to performance information. The voltage waveform data comprises the intensity of key depression and is provided for each respective key number. Solenoids, also provided for each of the keys, are activated upon output of the voltage waveform data, thereby automatically recreating the performance.

A variety of methods have been proposed to control the value of power voltage supplied to solenoids in an automatic performing apparatus such as an automatic piano. One such method is duty cycle control, whereby the duty cycle of a square wave is changed. The duty cycle control is most favorable since it minimizes the electricity loss in a transistor utilized as switching element.

U.S. Pat. No. 4,132,141 discloses an apparatus adopting the duty cycle control method. The apparatus first generates pulses of a constant width, and then modulates the pulse width in accordance with key depression intensity.

When it comes to driving a plurality of keys individually but simultaneously, however, the above apparatus requires a corresponding plurality of digital to analog converters (DAC's) and modulation circuits, thus complicating the circuit structure. Moreover, because of the need for a DAC and modulation circuit, high precision apparatus control is hampered and requires intricate adjustment. Further, a voltage comparator included in the modulation circuit tends to deteriorate after a long period of use, revealing its drawback in durability.

SUMMARY OF THE INVENTION

Wherefore, an object of this invention is to provide a solenoid drive system enabled to drive a plurality of keys simultaneously and individually with high precision, and also free from the need for adjustment without no deterioration over time.

In an automatic performing apparatus which activates solenoids with a value of electric power determined according to key depression intensity and recreates a performance according to performance information including key depression intensity and key number, a solenoid drive system from a first aspect of the present invention comprises storage means, writing means, readout means, holding means, and enabling control means as shown in FIG. 1.

The storage means stores, with respect to each of the key numbers, voltage waveform data representing an enabled period and a non-enabled period. The voltage waveform data varies according to key depression intensity. The writing means writes, upon arrival of the time to depress a key, data concerning the pulse height level of each segment of one cycle of the voltage waveform to the area of the storage means corresponding to the key to be depressed. The one cycle of the voltage waveform is segmented in every predetermined time period. The readout means reads out, in parallel, each of the data concerning the pulse height level for the respective keys from the storage means. The holding means temporarily stores each of the data read out by the readout means individually according to its key number. The enabling control means controls enabling of the solenoid corresponding to the key number included in the data read out.

From a second aspect of the invention, the voltage waveform data in the present solenoid drive system is written one after another to adjacent areas within the storage means but read out by the readout means from the areas remote from one another within the storage means.

From a third aspect of the invention, the voltage waveform data in the present solenoid drive system is written in remote areas within the storage means but read out from adjacent areas within the storage means.

From a fourth aspect of the invention, the voltage waveform data is the data concerning the pulse height level quantized by binary system.

From a fifth aspect of the invention, the storage areas of the storage means correspond respectively to each of the key number groups into which a predetermined number of key numbers are classified, and include bit memory areas corresponding to the key number.

From a sixth aspect of the invention, the solenoid drive system also comprises a prohibition means to prohibit the holding means from outputting data while the writing means is writing data in the storage means.

In operation, the writing means writes the voltage waveform data, as the data representing the pulse height level of each segment of one cycle of the voltage waveform, in the areas within the storage means corresponding to the key number. The voltage waveform is segmented in every predetermined time period. The voltage waveform data represents an enabled period and a non-enabled period of the solenoids, and varies according to key depression intensity. The readout means reads out, in parallel, each of the voltage waveform data from the areas within the storage means corresponding to each of the key numbers. The voltage waveform data is then temporarily stored within the corresponding holding means according to its key number. Responsive to the data stored within the holding means and according to its key number, the enabling control means controls enabling and non-enabling of the solenoids corresponding to the key number.

Thus, according to the present invention, all of the solenoids can be individually driven with a desired intensity. Hence, the quality of the performance is improved as a whole. Moreover, free from the modulation circuit or other circuit which needs adjustment, it is easier to manufacture the present solenoid drive system. The absence of those circuits which deteriorate in time makes unnecessary the adjustment after sales or installation. Further, the present system is inexpensive compared to the conventional apparatus adopting the pulse width modulation, pulse number modulation, and other similar method.

BRIEF DESCRIPTION OF THE DRAWINGS

FIGS. 10A and 10B are tables showing the relationship between output from an address generator, addresses of the memory, and latches;

FIG. 11 is a table showing how the data is read out from the memory;

FIGS. 13A and 13B are tables showing the relationship between address buses of the CPU, address terminals of the memory, and the output from an address generator.

DETAILED DESCRIPTION OF THE PREFERRED EMBODIMENT

Explained hereinafter is a solenoid drive system embodied in an automatic performing piano although it is understood that other embodiments are within the scope of the present invention.

Figure 1:
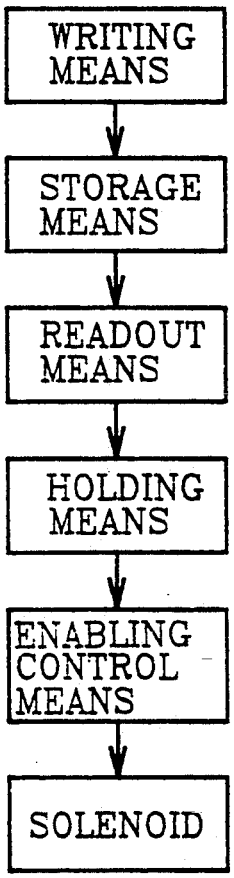
FIG. 1 is a block diagram showing the structure of a solenoid drive system according to the present invention.
Figure 2:
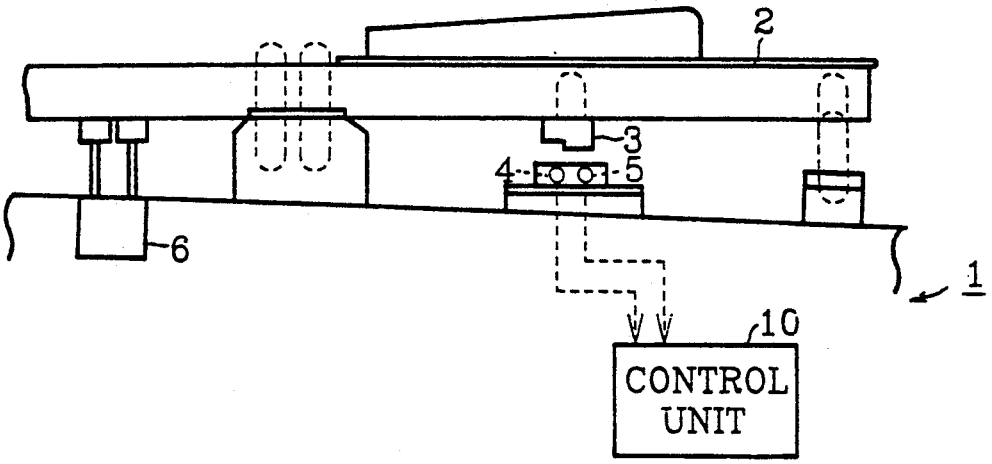
FIG. 2 is an illustration showing a performance information processing unit of an automatic performing piano according to one embodiment of the present invention.

An automatic performing piano 1, shown in FIG. 2, is provided with keys 2, stepped shutters 3, and key sensors 4 and 5. Each of the stepped shutters 3 is disposed below each of the keys 2, and blocks the light path between light emitting elements and light receiving elements of the key sensors 4 and 5 when a corresponding key 2 is depressed.

Intensity of key depression is perceived by measuring the time lag between the time key sensors 4 and 5 detect blocking of the light path. Performance information including the key number and the key depression intensity is stored in performance information storage means such as a floppy disc. Recording of the performance information is conducted according to an "event method" where depression or release of a key is recorded according to the key number, the depression intensity (the value for a key release is zero), and the time of the key depression or release only when depression or release of a key takes place. The timing at which key depression takes place is called an "on-event", and the timing of the key release is called an "off-event".

When reproducing a performance, the performance information stored in the performance information storage means is read out, event by event, by a control unit 10. When the value of a clock arrives at that of the time included in the read out performance information, the corresponding event is executed.

As a first step of the event execution, voltage waveform data to be used in driving the solenoids 6 is generated in accordance with the key depression intensity included in the performance information. The voltage waveform data is next stored in a RAM which will be described later. Consequently, control signals are generated, according to the voltage waveform data, to control enabling or non-enabling of the solenoids 6.

Figure 3:
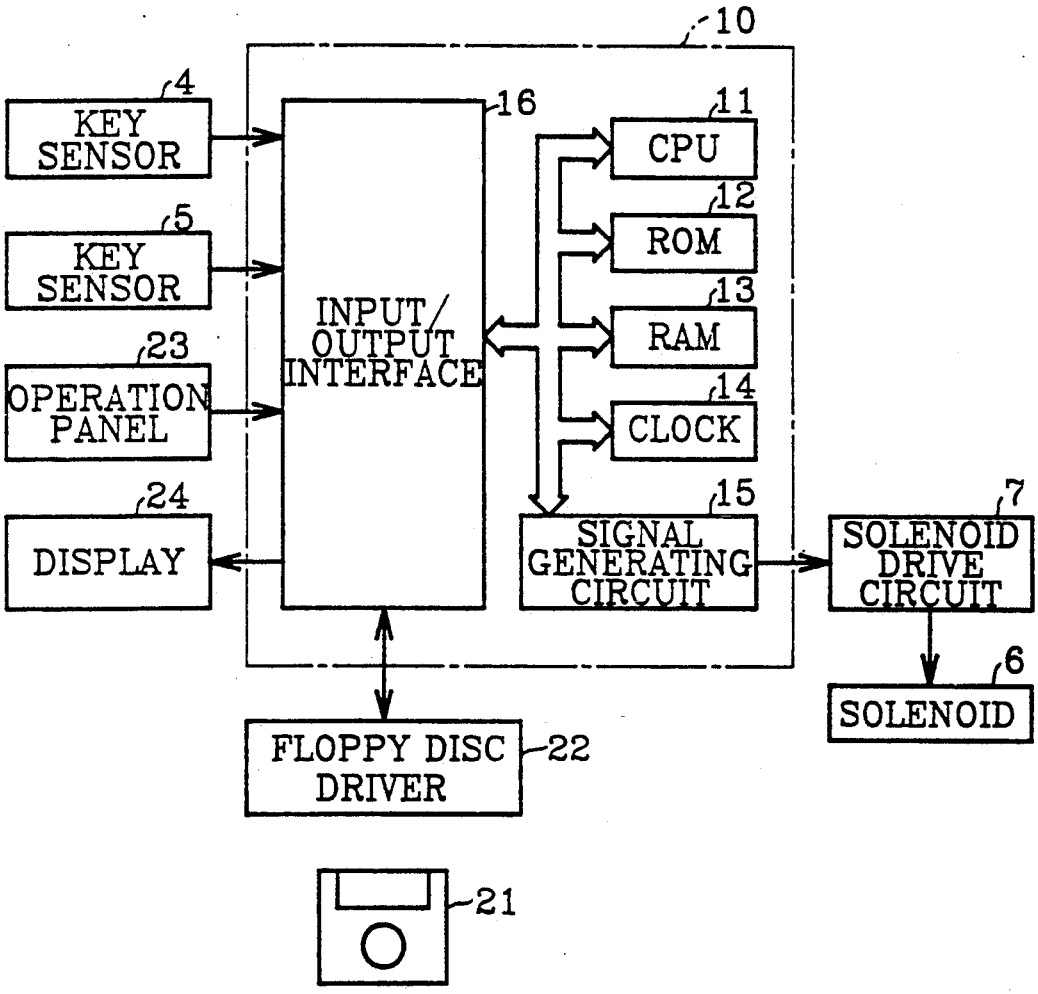
FIG. 3 is a block diagram showing the electrical connection of the embodied solenoid drive system.

As shown in FIG. 3, the control unit 10 is a calculation circuit comprising a CPU 11, a ROM 12, a RAM 13, a clock 14, and a signal generating circuit 15 which generates signals to control the drive of the solenoids 6. The control unit 10 is connected via an input/output interface 16 to the key sensors 4 and 5. The signal generating circuit 15 is connected via a solenoid drive circuit 7 to the solenoids 6. The solenoid drive circuit 7 may comprise a transistor. In this case, the control signals are sent out to the base of the transistor, and the solenoids 6 are supplied with the power voltage between a power source and the transistor collector.

The control unit 10 is also connected via the input/output interface 16 to a floppy disc driver 22 to drive a floppy disc 21, an operation panel 23 to select the mode of operation, and a display 24.

Figure 4:
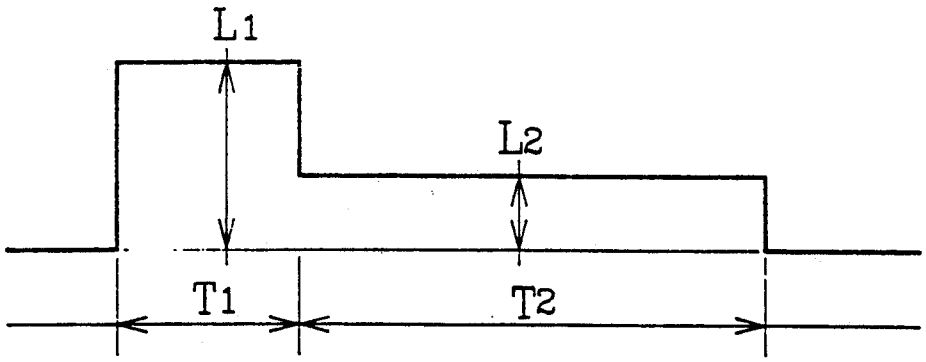
FIG. 4 is a timing diagram showing a waveform of the average electric power utilized for controlling the drive of the solenoids in the present embodiment.

As shown in FIG. 4, the average waveform of power voltage driving the solenoids 6 is divided into two parts, i.e. a time period T1 during which a voltage level L1 responsive to key depression intensity is supplied, and a second time period T2 during which the voltage level L2 required for the solenoids 6 to keep the keys 2 depressed is maintained.

Figure 5A:
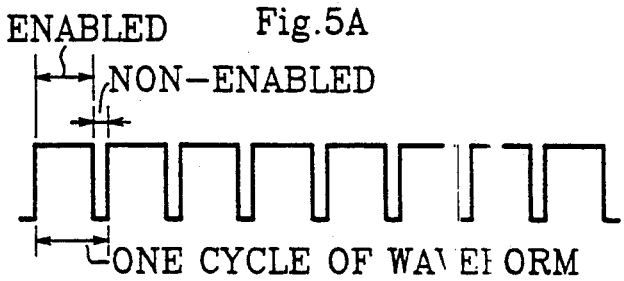
FIGS. 5A, 5B, and 5C are diagrams showing the pulse strains to obtain the electric power shown in FIG. 4.
Figure 5B:
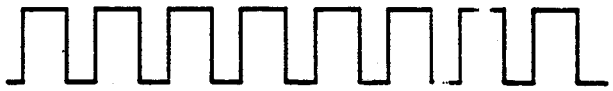
Figure 5C:
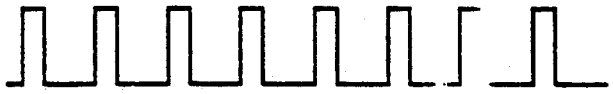

The control signals for the voltage level L1 in response to a larger key depression intensity have square waves with a larger duty cycle as shown in FIG. 5A, whereas those control signals in response to a lesser key depression intensity have a smaller duty cycle as shown in FIG. 5B. The control signals for the voltage level L2 are further smaller in duty cycle of the square waves as shown in FIG. 5C.

Figure 6:
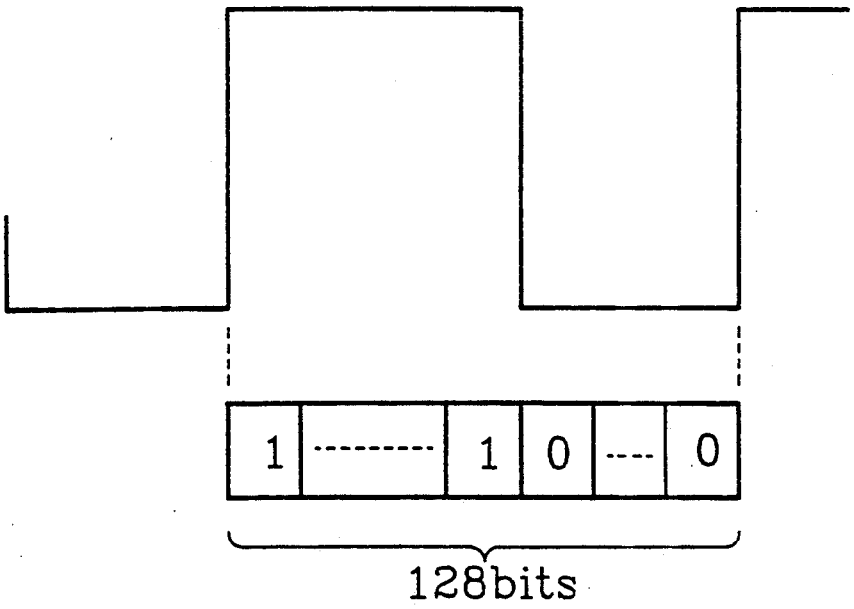
FIG. 6 is a diagram showing the relationship between voltage waveform and control signals.

The solenoids 6 are driven with a desired intensity by controlling the duty cycle of the control signals as shown in FIGS. 5A and 5B in accordance with depression intensity. FIG. 6 shows the voltage waveform data utilized in this embodiment where one cycle of the solenoid control electrical signal is divided in a predetermined time period into one hundred and twenty-eight bit segments, each bit "1" or "0" representing the voltage level during the corresponding time period.

In order to prevent "beating" of the solenoids 6, a high frequency is preferable for the driving cycle of the control signals for the solenoids 6. On the other hand, a lower frequency is preferable for the switching operation of the transistor of the solenoid drive circuit 7. Thus, a 15 kHz or so frequency signal is preferably selected as a compromise.

Figure 7:
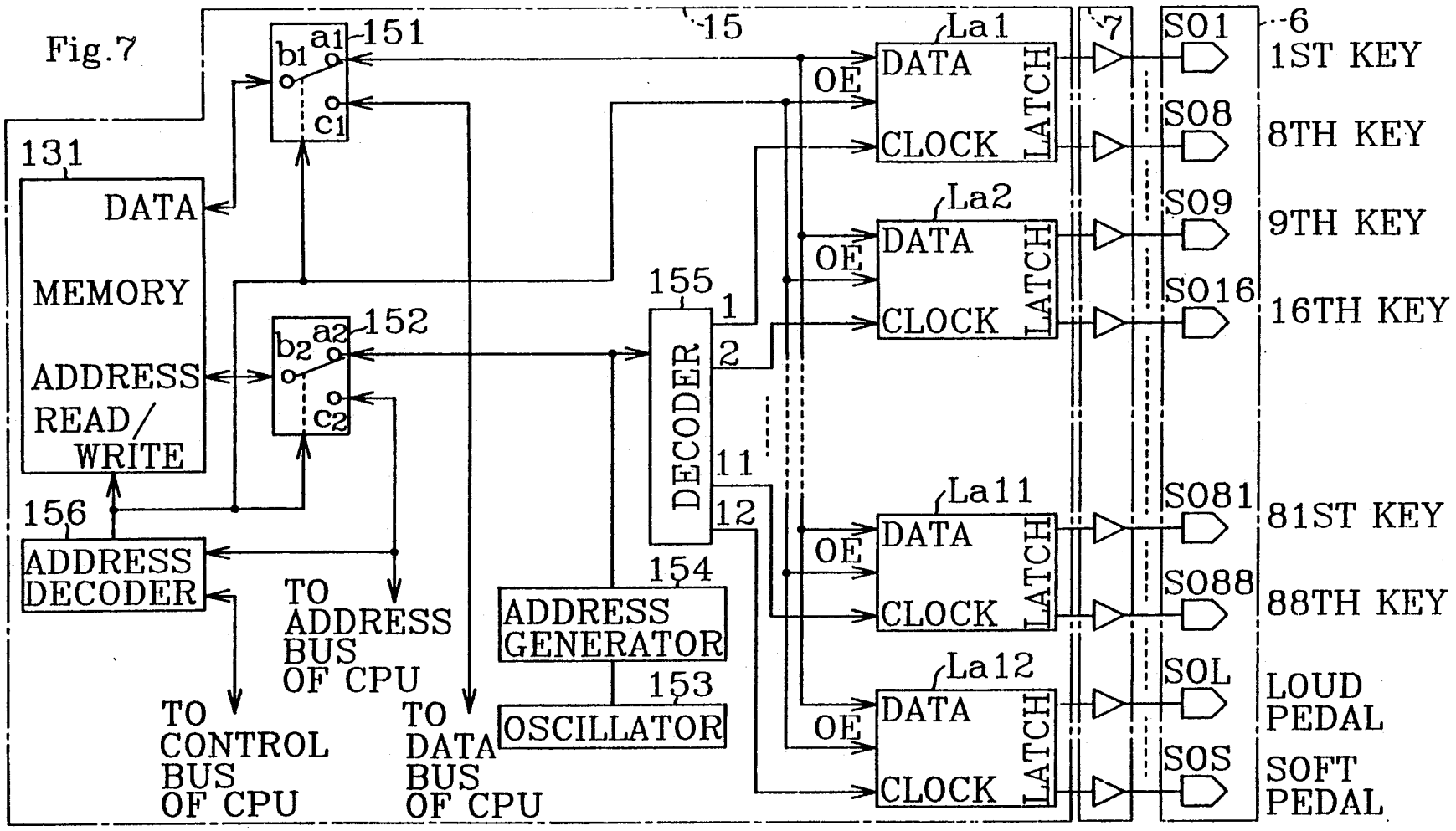
FIG. 7 is a block diagram showing the structure of a signal generating circuit shown in FIG. 3 used to generate drive signals for the solenoids.

As shown in FIG. 7, eight solenoids SO1–SO8, corresponding respectively to a first key through an eighth key, are connected via the solenoid drive circuit 7 to a latch La1. Another eight solenoids SO9–SO16, corresponding respectively to a ninth key through a sixteenth key, are connected via the solenoid drive circuit 7 to a latch La2. In the same manner, every eight solenoids 6 constitutes a group of solenoids, and each group is connected via the solenoid drive circuit 7 to its respective latch. The last group of solenoids 6, consisting of solenoids SO81–SO88 corresponding respectively to an eighty-first key through an eighty-eighth key, is connected via the solenoid drive circuit 7 to a latch La11. Solenoids SOL and SOS, corresponding respectively to a loud pedal and a soft pedal, are connected via the solenoid drive circuit 7 to a latch La12. The latches La1–La12 correspond to holding means, and the solenoid drive circuit 7 corresponds to enabling control means.

A data input to memory 131 which serves as storage means is connected to a terminal b1 of multiplexer 151. A terminal a1 of multiplexer 151 is connected to data input terminals of latches La1–La12. A terminal c1 of multiplexer 151 is connected to a data bus of the CPU 11.

An address terminal of memory 131 is connected to terminal b2 of the multiplexer 152. Terminal a2 of the multiplexer 152 is connected to an address generator 154 which receives clock signals from oscillator 153. Terminal c2 of multiplexer 152 is connected to an address bus of the CPU 11.

The address generator 154 is further connected to a decoder 155 which is connected to clock terminals of the latches La1–La12.

A read/write switching terminal of memory 131 is connected to an address decoder 156 which is connected to both a control bus and the address bus of the CPU. The address decoder 156 is further connected to the multiplexers 151 and 152 and to OE (output enable) terminals of the latches La1–La12.

In order to execute a write operation according to the sequence of the addresses provided, the address bus of the CPU 11 and the address inputs to memory 131 are connected such that all address bit positions are in correspondence with each other. However, the address output signals from address generator 154 and the address input signals of memory 131 are not coupled in the normal correspondence, in order to read out from every one hundred twenty-ninth address in the memory.

Writing the voltage waveform data to the memory 131 shown in FIG. 7 is performed by the CPU 11, while reading out of the voltage waveform data from the memory 131 is controlled by the address generator 154. The writing of data by the CPU 11 takes priority for access to the memory 131 over reading out of data. Thus, the address generator 154 performs data read out while no write operation is taking place.

The process steps of writing the voltage waveform data effected by the CPU 11 will now be explained referring to FIG. 8.

Step S1 represents a main routine and includes various operations such as reading out of performance information, display thereof, time keeping, transposition, volume control, and fast-forwarding. In step S2, it is determined whether it is time to execute the event represented by the performance information read out. Specifically, when the value of the clock 14 equals the value of time included in the performance information, it is determined to be time to execute the event represented by the performance information. When these values are not equal, i.e. there is no event to be executed, the process returns to step S1 as the main routine.

Prior to executing a performance reproduction process beginning with the main routine at step S1, the memory 131 is initialized and stores a value of "0" for pulse height level in all locations.

When executing an event according to performance information, the CPU 11 sends out a write signal to the address decoder 156 via the control bus. In response to the output from the address decoder 156, the memory 131 enters the "write" mode, ready to receive data, while terminal b1 of multiplexer 151 is connected to terminal c1, terminal b2 of multiplexer 152 is connected to terminal c2, and latches La1–La12 are supplied with a logic high on the OE terminals, thereby prohibiting outputting from the latches.

Upon receiving the performance information, the CPU 11 calculates in step S3 an average value of electric power to supply to the solenoids 6 according to the depression intensity (depression velocity). Voltage waveform data is obtained from the average value of the calculated electric power. An address and a bit position of the memory 131 to receive the voltage waveform data is calculated in accordance with the key number. The above voltage waveform data is a pulse train of data, with the pulse train segmented into a plurality of predetermined time periods to form a bit stream, each bit representing a higher voltage "1" or a zero voltage "0" in pulse height level.

In subsequent step S4, the calculated waveform data of the solenoid control signal is written to the calculated address and bit position of the memory 131. Regardless of whether the performance information concerns an on-event or an off-event, the above steps S1 thorough S4 are performed. The voltage waveform data for an off-event is, by definition, a bit train data with a value of "0" in pulse height level throughout each of the segments.

Figure 9:
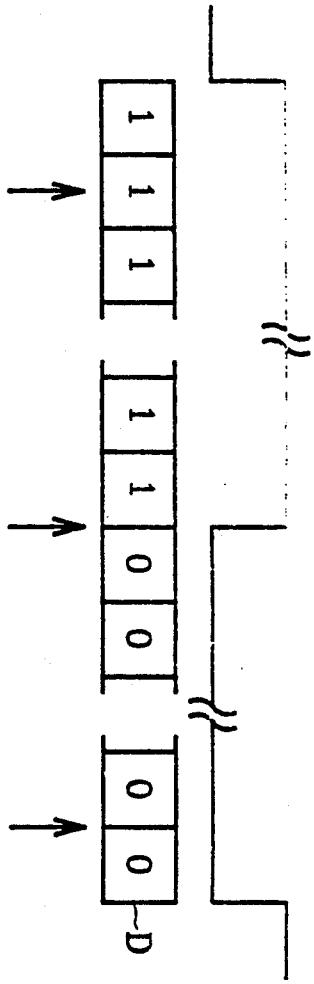
FIG. 9 is a table showing how the data is written into memory.

FIG. 9 shows how the data is written into the memory 131. The addresses in the memory 131 are represented by hexadecimal notation. Shown in FIG. 9 is the case wherein a first key is pressed down with the intensity represented by fifty percent of duty cycle for the solenoid control signal. The area in the memory 131 for the solenoid SO1 corresponding to the first key is the bit position D1 of the memory with addresses ranging from 0000H to 007FH. Since fifty percent of one hundred twenty-eight bits is sixty-four, i.e. 0040H in hexadecimal notation, "1" is written into the bit position D1 from memory address 0000H to memory address 003FH, while a "0" is written into the bit position D1 from memory address 0040H to memory address 007FH. The number of bits with "1" written equals to the number of bits with "0" written. Thus, the voltage waveform data which will correspond to a control signal of fifty percent duty cycle is stored in memory 131.

When another key from second to eighth key is pressed down at the same time as the first key, a "1" or "0" is written into the corresponding bit position among bit positions D2 to D8 of memory addresses 0000H to 007FH. The first to eighth keys correspond to latch La1. In response to depression of the ninth key, which corresponds to latch La2, data is written to the bit position D1 of memory address 0080H to 00FFH.

It will be now explained how the data is read out from the memory 131. In the absence of access by CPU 11 indicating completion of a write operation, data may be read out from via the address decoder 156. Terminals a1 and b1 of multiplexer 151 are connected, while terminals a2 and b2 of multiplexer 152 are also connected. When the latches La1–La12 receive a logic "0" level signal on the OE terminal, the latches La1–La12 are enabled and output data.

The data stored in the memory 131 is now to be read out. Specifically, according to the address generated by the address generator 154, the data in the memory 131 is read out and latched in one of the appropriate latches La1–La12. Since the address generator 154 is connected with the address terminals of the memory 131 as shown in FIG. 13A, the data in the memory 131 is not read out according to its normal sequence, but from every one hundred twenty-ninth address.

As shown in FIG. 13A, output terminals Q10–Q4 of address generator 154 designate the position of all the one hundred twenty-eight bits composing one cycle of the solenoid drive signal, and output terminals Q3–Q0 designate latches La1–La12.

The terminals Q3–Q0 and Q10–Q4 of the address generator 154 are connected as shown to the address terminals A10–A0 of the memory 131. Decoder 155 decodes the first four address bits output via the terminals Q3–Q0 of the address generator 154. In this embodiment, the address buses of the CPU 11 and the address terminals of the memory 131 are connected in accordance with the normal correspondence of the terminals. On the other hand, the connection of the output terminals of the address generator 154 and the address terminals of the memory 131 is not according to the normal correspondence of the terminals since the data is read out skipping one hundred twenty-eight addresses.

The connection between the output from the address generator 154, address of the memory 131, and the latches La1–La12 will now be explained referring to FIG. 10. The initial state of the bits output from the address generator 154 are "0" in all bit positions, and incremented, bit by bit, from the previous state. When the bits are in the state shown in FIG. 10A, the bits Q10–Q4 represent address 0000H of the memory 131, while bits Q3–Q0 are set to "0000" and designate latch La1.

When the bits shown in FIG. 10A are incremented by one value, the bits changes as shown in FIG. 10B. In FIG. 10B, the bits Q10–Q4 represent the address 0080H of the memory 131. The first four bits Q3–Q0 are set to "0001" and select latch La2.

Reading out of the data from the memory 131 connected in the manner shown in FIG. 13A is now explained referring to FIG. 11.

The first bit of each voltage waveform data for controlling enabling of the solenoids SO1–SO8 is read out from the address 0000H and then latched in latch La1. Subsequently, the first bit of each voltage waveform data for the solenoids SO9–SO16 is read out from the address 0080H and latched in latch La2. Further, the first bit of each voltage waveform data for the solenoids SO17–SO24 is read out from the address 0100H and latched in latch La3.

Thus, the data read out from the memory 131 are latched in the corresponding latches one after another. After the first bit of each voltage waveform data for controlling enabling of solenoids SOL and SOS is read out from the address 0580H and latched in latch La12, the second bit of each voltage waveform data for controlling enabling of solenoids SO1–SO8 is read out from the address 0001H and latched in the latch La1. Next, the second bit of each waveform data for the solenoids SO9–SO16 is read out from address 0081H and latched in latch La2.

A similar procedure is conducted for all the bits of the voltage waveform data for one pulse cycle, thus ending in reading out the one hundred twenty-eighth bit of each waveform data for controlling enabling of solenoids SOL and SOS, and latching the data in latch La12. The operation of reading out is repeated as long as no data is being written into the memory 131 by the CPU 11, thereby repeating activation of the solenoids 6 corresponding to the key to be depressed.

Figure 8:
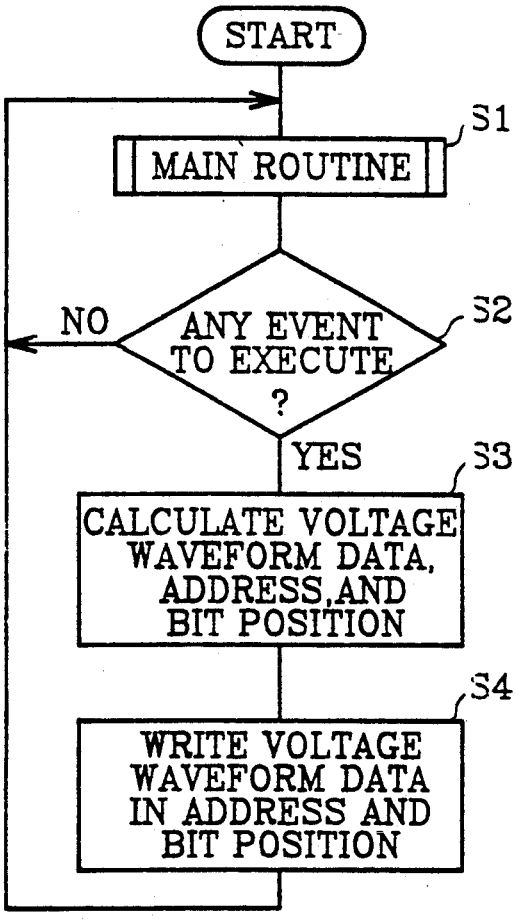
FIG. 8 is a flowchart showing a data writing operation by a CPU.

During the time period from step S1, FIG. 8, to an on-event, and after an off-event, a solenoid 6 is not activated by the reading operation itself since the bit data read out from the memory 131 is "0" in value.

Thus, the present solenoid drive system stores and reads out voltage waveform data expressed by bit streams in two PCM codes "1" and "0" for each solenoids 6, and is thereby capable of activating all the solenoids 6 individually with a desired intensity. The reproduced performance is therefore superior in fidelity.

For example, when reproducing a key depression of "pianissimo", it is required to control the electricity supplied to the solenoids with a precision of one to two percent of average electricity to be supplied. Since the present invention is capable of setting the value of one bit or all one hundred twenty-eight bits to a logic "1" or "0", the present solenoid drive system successfully controls the electricity for all the keys with the precision of less than 1 percent of the average electricity.

Additionally, without a pulse modulation circuit or other similar circuit which requires adjustment, and also without circuits which deteriorate over time, the present solenoid drive system is less labor-consuming to manufacture, and free from adjustment after sales or installation.

Further, the present solenoid drive system is inexpensive compared to those systems adopting pulse width modulation, pulse number modulation, or other similar method.

This invention has been described above with reference to a preferred embodiment as shown in the drawings. Modifications and alterations may become apparent to one skilled in the art upon reading and understanding the specification. Despite the use of the embodiment for illustration purposes, it is intended to include all such modifications and alterations within the scope and the spirit of the appended claims.

In this spirit, it should also be noted that in the embodiments as shown and described, one cycle of the voltage waveform is segmented into one hundred twenty-eight bits, however, the number of bits may be determined and adjusted as required.

Similarly, although the data is written into the addresses beginning with address 0000H in the above described embodiment, the data may be written beginning with any address other than 0000H, provided the following addresses are in sequence.

Further, explained in the above described embodiment is writing data to adjacent addresses in the memory 131 and reading out the data from the addresses remote from one another with a predetermined number of addresses therebetween. It is because a CPU in general is faster in writing to adjacent addresses than to remote addresses. However, in another embodiment, it is possible to write to the remote addresses and read out from adjacent addresses. FIG. 13B shows a table of address line to be referred to in such an embodiment.

In contrast to FIG. 13A, FIG. 13B shows that the output terminals of the address generator 154 and the address terminals of the memory 131 are connected according to the conventional sequence of the terminals, while the address buses of the CPU 11 and the address terminals of the memory 131 are connected in a different sequence.

Figure 12:
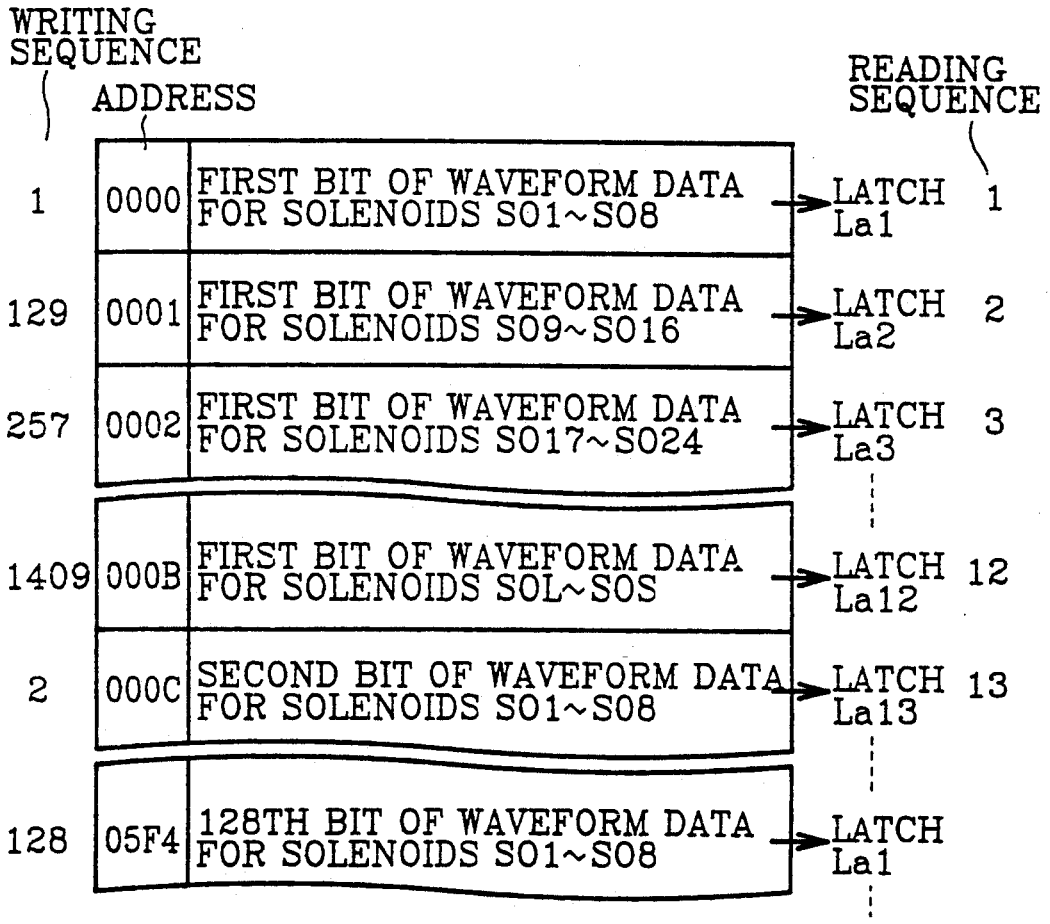
FIG. 12 is a table showing how the data is read out in a modification of another embodiment of the present solenoid drive system.

It will be now explained how the data is written and read out in this case referring to FIG. 12.

In a write operation, the first bit of each voltage waveform for controlling enabling of the solenoids SO1–SO8 is first stored in address 0000H. Subsequently, the second bit of each voltage waveform data for controlling enabling of the solenoids SO1–SO8 is stored in address 000CH, i.e. the one hundred and twenty-eighth address from the address used in the previous storage. A similar operation is conducted for all one hundred twenty-eight bits of the one cycle. The one hundred twenty ninth bit of data is stored in address 0001H adjacent to the address storing the first data. The one hundred twenty ninth data is the first bit of data of each voltage waveform data for controlling enabling of the solenoids SO9-SO16. Thus, storage of data in the memory 131 may be conducted skipping a predetermined number of addresses, and not according to the normal sequence of addresses.

On the other hand, output of the data starts at the lowest address and proceeds in sequence. Specifically, the first bit of each voltage waveform data for the solenoids SO1-SO8 is first read out from address 0000H. Subsequently, the first bit of each voltage waveform data for the solenoids SO9-SO16 is read out from address 0001H. Thus, output is effected according to the sequence of the addresses.

Although explained in the embodiment is a solenoid drive system for an automatic performing piano, it should also be noted that the present invention may be applied to a hammer to strike a one or more bells of wall clock, a carillon, a xylophone, or other similar apparatus where key numbers and solenoids correspond to each other one on one.

Wherefore having described the present invention, what is claimed is:

1. A solenoid drive system for an automatic performing apparatus in which said automatic performing apparatus includes a plurality of solenoids, each of said plurality of solenoids individually activatable according to key number data, said solenoids activatable with a variable intensity determined according to key depression intensity data included in performance information associated with an automatic performing apparatus key and utilized to recreate a performance, said system comprising:

data storage means, for storing said performance information including a plurality of voltage waveform data groups, each voltage waveform data group including a plurality of segments, each segment storing one data element, each of said segments representing enabled and non-enabled time periods for a corresponding solenoid associated with a predetermined key number of said automatic performing apparatus, at least one voltage waveform data group segment from each of said voltage waveform data groups varying according to said key depression intensity data included in said performance information;

means for writing to said data storage means, each of said voltage waveform data groups including a plurality of data bits corresponding to said plurality of segments comprising each of said voltage waveform data groups;

readout means, coupled to said data storage means, for reading out each of said voltage waveform data groups, holding means, coupled to said readout means, for temporarily holding each of said voltage waveform data groups for each of said keys of said automatic performing apparatus; and solenoid enabling means, responsive to said voltage waveform data groups temporarily stored in said holding means, and coupled to said plurality of solenoids, for selectively enabling at least one of said plurality of solenoids according to the key number associated with said at least one of said plurality of solenoids, and for providing a solenoid energizing signal having a value determined as a function of said voltage waveform data group segment data.

2. The system of claim 1 wherein said means for writing writes said voltage waveform data groups to consecutively numbered storage area locations within said data storage means; and wherein said readout means reads out said voltage waveform data groups from non-consecutively numbered storage area locations within said data storage means.

3. The system of claim 1 wherein said means for writing writes said voltage waveform data groups to non-consecutively numbered storage area locations within said data storage means; and wherein said readout means reads out said voltage waveform data groups from consecutively numbered storage area locations within said data storage means.

4. The system of claim 1 wherein said data storage means includes a memory unit.

5. The system of claim 1 wherein said data storage means includes a disk.

6. The system of claim 1 wherein said means for writing writes said voltage waveform data groups to said data storage means upon the detection of an event included in said performance information.

7. The system of claim 6 wherein said event includes an "on" event activating a solenoid associated with a key.

8. The system of claim 6 wherein said event includes an "off" event de-activating a solenoid associated with a key.

9. The system of claim 1 wherein said key includes a striking hammer.

10. The system of claim 1 wherein said automatic performing apparatus is selected from the group consisting of a piano, a carillon and a xylophone.

11. The system of claim 1 further including means for prohibiting said readout means from reading out said voltage waveform data groups from said data storage means during a time period in which said means for writing writes to said data storage means.

12. A solenoid drive system for an automatic performing apparatus in which said automatic performing apparatus includes a plurality of solenoids, each of said plurality of solenoids individually activatable according to key number data, said solenoids activatable with a variable intensity determined according to key depression intensity data included in performance information associated with an automatic performance apparatus key, and utilized to recreate a performance, said system comprising:

data storage means, for storing said performance information including a plurality of voltage waveform data groups, each voltage waveform data group including a plurality of segments, each segment storing one data element, each of said segments representing enabled and non-enabled time periods for a corresponding solenoid associated with a predetermined key number of said automatic performing apparatus, at least one voltage waveform data group segment from each of said voltage waveform data groups varying according to said key depression intensity data included in said performance information;

means for writing to said data storage means, each of said voltage waveform data groups including a plurality of data bits corresponding to said plurality of segments comprising each of said voltage waveform data groups, wherein said means for writing writes said voltage waveform data groups to consecutively numbered storage area locations within said data storage means;

readout means, coupled to said data storage means, for reading out each of said voltage waveform data groups, and wherein said readout means reads out said voltage waveform data groups from non-consecutively numbered storage area locations;

holding means, coupled to said readout means, for temporarily holding each of said voltage waveform data groups fro each of said keys of said automatic performing apparatus; and solenoid enabling means, responsive to said voltage waveform data groups temporarily stored in said holding means, and coupled to said plurality of solenoids, for selectively enabling at least one of said plurality of solenoids according to the key number of a key associated with said at least one of said plurality of solenoids, and for providing a solenoid energizing signal having a value determined as a function of said voltage waveform data group segment data.

13. A solenoid drive system for an automatic performing apparatus in which said automatic performing apparatus includes a plurality of solenoids, each of said plurality of solenoids individually activatable according to key number data, and further activatable with a variable intensity determined according to key depression intensity data included in performance information associated with an automatic performing apparatus key, and utilized to recreate a performance, said system comprising:

data storage means, for storing said performance information including a plurality of voltage waveform data groups, each voltage waveform data group including a plurality of segments, each segment storing one data element, each of said segments representing enabled and non-enabled time periods for a corresponding solenoid associated with a predetermined key number of said automatic performing apparatus, at least one voltage waveform data group segment from each of said voltage waveform data groups varying according to said key depression intensity data included in said performance information;

means for writing to said data storage means, for each of said voltage waveform data groups, a plurality of data bits corresponding to said plurality of segments comprising each of said voltage waveform data groups, and wherein said means for writing writes said voltage waveform data groups to non-consecutively numbered storage area locations within said data storage means;

readout means, coupled to said data storage means, for reading out each of said voltage waveform data groups, and wherein said readout means reads out said voltage waveform data groups from consecutively numbered storage area locations;

holding means, coupled to said readout means, for temporarily holding each of said voltage waveform data groups for each of said keys of said automatic performing apparatus; and solenoid enabling means, responsive to said voltage waveform data groups temporarily stored in said holding means, and coupled to said plurality of solenoids, for selectively enabling at least one of said plurality of solenoids according to the key number of a key associated with said at least one of said plurality of solenoids, and for providing a solenoid energizing signal having a value determined as a function of said voltage waveform data group segment data.

* * * * *